US011772750B1

(12) United States Patent
Xiong et al.

(10) Patent No.: US 11,772,750 B1
(45) Date of Patent: Oct. 3, 2023

(54) RETRACTABLE DAVIT ASSEMBLY AND RELATED METHODS

(71) Applicant: Hangzhou Sino Eagle Yacht Co., Ltd., Fuyang Hangzhou (CN)

(72) Inventors: Ying Xiong, Fuyang Hangzhou (CN); Jure Zule, Fuyang Hangzhou (CN); Lianggang He, Fuyang Hangzhou (CN)

(73) Assignee: Hangzhou Sino Eagle Yacht Co., Ltd., Fuyang Hangzhou (CN)

( * ) Notice: Subject to any disclaimer, the term of this patent is extended or adjusted under 35 U.S.C. 154(b) by 20 days.

(21) Appl. No.: 17/574,011

(22) Filed: Jan. 12, 2022

(51) Int. Cl.
*B63B 27/16* (2006.01)
*B63B 27/08* (2006.01)
*B63B 23/02* (2006.01)

(52) U.S. Cl.
CPC ..... *B63B 27/16* (2013.01); *B63B 27/08* (2013.01)

(58) Field of Classification Search
CPC ..... B63B 23/00; B63B 23/02; B63B 23/04; B63B 23/06; B63B 23/08; B63B 23/10; B63B 27/00; B63B 27/08; B63B 27/10; B63B 27/16
USPC ..... 114/259, 365, 366, 368, 369, 370, 372, 114/373
See application file for complete search history.

(56) References Cited

U.S. PATENT DOCUMENTS 1,094,348 A 4/1914 Tjader
2,141,181 A * 12/1938 Bel Geddes ..... B63B 19/00 114/259
3,747,137 A * 7/1973 Simpson ..... B63B 23/26 114/368
6,626,126 B1 9/2003 Kalve
8,631,752 B2 * 1/2014 Hauersperger ..... B63B 23/06 114/259

FOREIGN PATENT DOCUMENTS

| | | | |
|---|---|---|---|
| CN | 101786489 | | 7/2010 |
| CN | 201573776 | | 9/2010 |
| CN | 201573776 | U | 9/2010 |
| CN | 202089213 | U | 12/2011 |
| CN | 206704467 | U | 12/2017 |
| CN | 209305798 | | 8/2019 |
| CN | 216070408 | | 3/2022 |
| DE | 8803864 | U1 | 5/1988 |
| DE | 19808491 | A1 | 9/1998 |
| EP | 3753841 | A1 | 12/2020 |
| FR | 2862274 | A1 | 5/2005 |
| JP | 51100590 | A2 | 9/1976 |
| JP | 2016010997 | | 1/2016 |

(Continued)

OTHER PUBLICATIONS

Wei et al.; The Anti Swing Strategy of Davit System to Unmanned Surface Vehicle at Sea; Shai-Liang et al.; Aug. 2020.

(Continued)

*Primary Examiner* — Daniel V Venne
(74) *Attorney, Agent, or Firm* — Allen, Dyer, Doppelt & Gilchrist, P.A.

(57) ABSTRACT

A retractable davit assembly includes a davit arm that retracts into a davit arm channel formed within the internal volume of a deck of the superstructure of a yacht or other vessel. An outer end of the davit arm includes a fairing matching a profile of the surrounding outer edge of the deck, such that that davit arm is concealed when retracted.

20 Claims, 6 Drawing Sheets

(56) References Cited

FOREIGN PATENT DOCUMENTS

| | | | |
|---|---|---|---|
| KR | 20130107571 | | 10/2013 |
| KR | 101833987 | B1 | 3/2018 |
| KR | 20210000557 | A | 1/2021 |
| NO | 325214 | B1 | 2/2008 |

OTHER PUBLICATIONS

China National Intellectual Property Administration; International Search Report and Written Opinion for PCT/CN2023/071785; dated May 18, 2023; entire document.

* cited by examiner

RETRACTABLE DAVIT ASSEMBLY AND RELATED METHODS

FIELD OF THE INVENTION

The present invention relates to davits, and more particularly to davits carried by yachts.

BACKGROUND

Yachts and other large marine vessels frequently carry one or more dinghies, lifeboats or other tenders. When this is the case, some form of davit is usually also provided to facilitate launching and retrieval. While convenient and often indispensable, davits take up valuable deck space and can also spoil the aesthetics of sleek, modern yachts. While a davit could be dismounted and stowed somewhere, the time and labor required to set up and take down the davit would be counterproductive. While many useful davit designs exist, it would be desirable to have a davit that is readily utilized but easily stowed when not required.

SUMMARY OF THE INVENTION

In view of the foregoing, it is an object of the present invention to provide a yacht with a retractable davit assembly. According to an embodiment of the present invention, a yacht with a retractable davit assembly includes a hull having a plurality of hull sides and a superstructure arranged on the hull and including at least one deck raised thereabove. The deck has upper and lower deck surfaces defining an internal deck volume therebetween, with a davit arm passage being formed within the internal deck volume having a terminal opening located on an outer deck edge. A length of the davit arm passage is greater than a deck internal height between the upper and lower deck surfaces.

A davit arm extending between an inner arm end and an outer arm end is mounted in the davit arm passage and movable between a retracted position, in which the outer arm end is located at the outer deck edge, and an extended position where the outer arm end is extended outwardly of the outer deck edge past one of the plurality of hull sides. A davit bearing arrangement is located in the davit arm passage and carries the davit arm for movement between the retracted and extended positions. An arm actuation assembly engages the davit arm in the davit arm passage and is operable to drive the davit arm between the retracted and extended positions. A davit hoist assembly including a hoist line extendable and retractable from the davit arm proximate the outer arm end and a hoist operable to extend and retract the hoist line.

According to an aspect of the present invention, the davit arm end extends out past a stern of the yacht. According to another aspect, the davit arm is extendable to a dinghy storage position over a dinghy storage platform intermediate the retracted and extended positions. According to an additional aspect, the davit arm includes a fairing at the outer arm end, the fairing matching a profile of the outer deck edge surrounding According to another aspect, the davit bearing arrangement includes a first stationary slide rail connected in the davit arm passage extending along the length thereof, a first moving slide bearing connected to the arm support portion and riding on the first stationary slide rail, a first moving slide rail extending along the extension portion, and a first stationary slide bearing fixed in the terminal opening and slidably supporting the first moving slide rail.

These and other objects, aspects and advantages of the present invention will be better appreciated in view of the drawings and following detailed description of preferred embodiments.

DETAILED DESCRIPTION OF PREFERRED EMBODIMENTS

Figure 1:
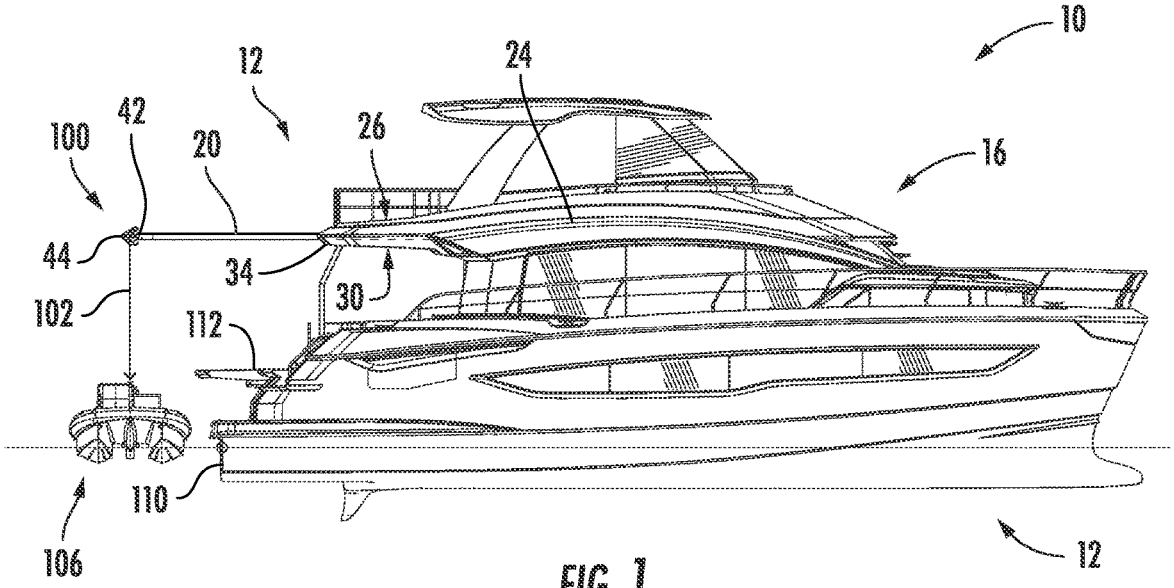
FIG. 1 is a side view of a yacht with a retractable davit assembly, according to an embodiment of the present invention, a davit arm of the davit assembly being in a fully extended position, with hidden components shown in broken lines.
Figure 2:
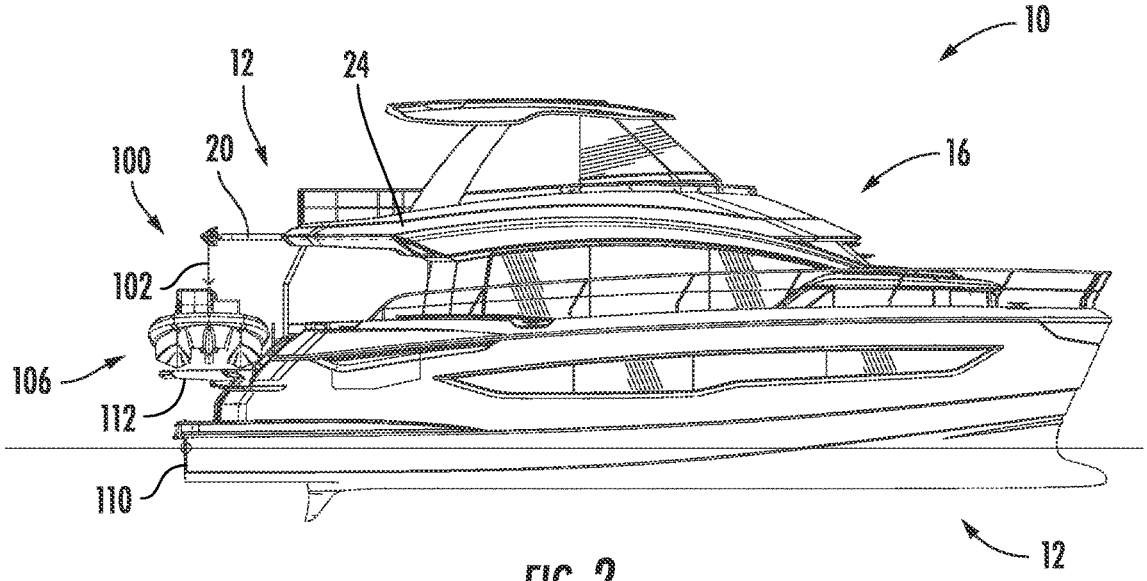
FIG. 2 is a side view of the yacht of FIG. 1, with the davit arm in a dinghy storage position, with hidden components shown in broken lines.
Figure 3:
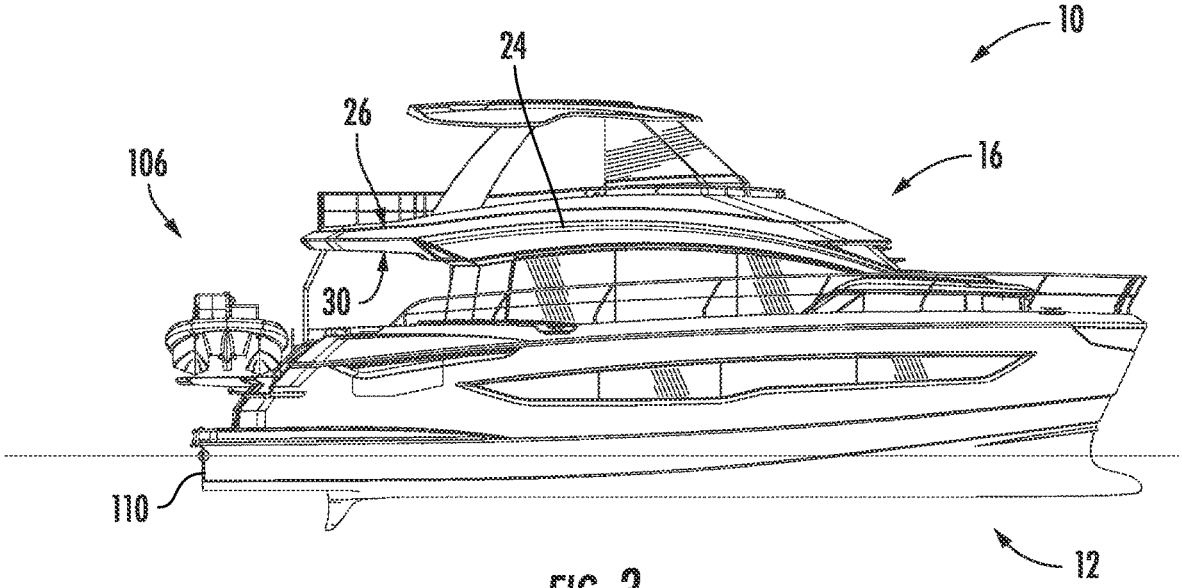
FIG. 3 is a side view of the yacht of FIG. 1, with the davit arm in a fully retracted position.
Figure 4:
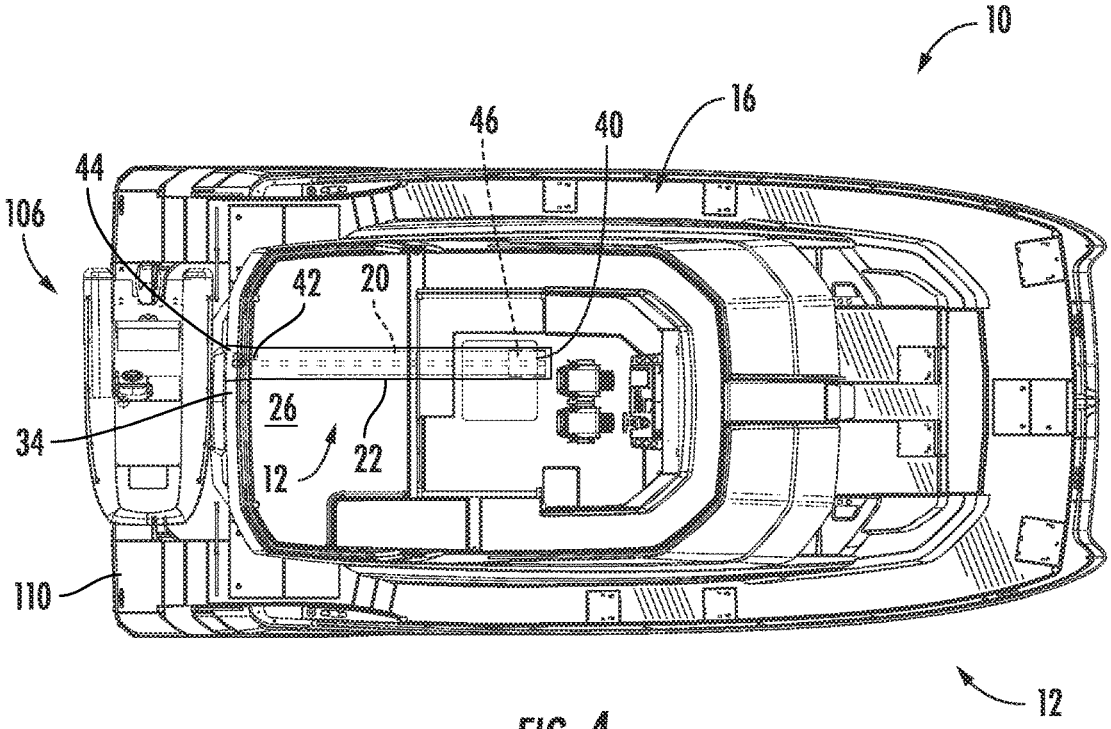
FIG. 4 is a top view of the yacht of FIG. 1, with the davit arm in the fully retracted position, with hidden components shown in broken lines.

Referring to FIGS. 1-4, according to an embodiment of the present invention, a yacht 10 with a retractable davit assembly 12 comprises a hull 14 and a superstructure 16 arranged on the hull 14. The davit assembly 12 includes a davit arm 20 that is retractable into a davit arm passage 22 defined within the internal volume of a deck 24 of the superstructure 16 between upper and lower deck surfaces 26, 30. Consequently, the davit arm 20 is concealed within the deck 24 when fully retracted (as in FIGS. 3 and 4).

Figure 5:
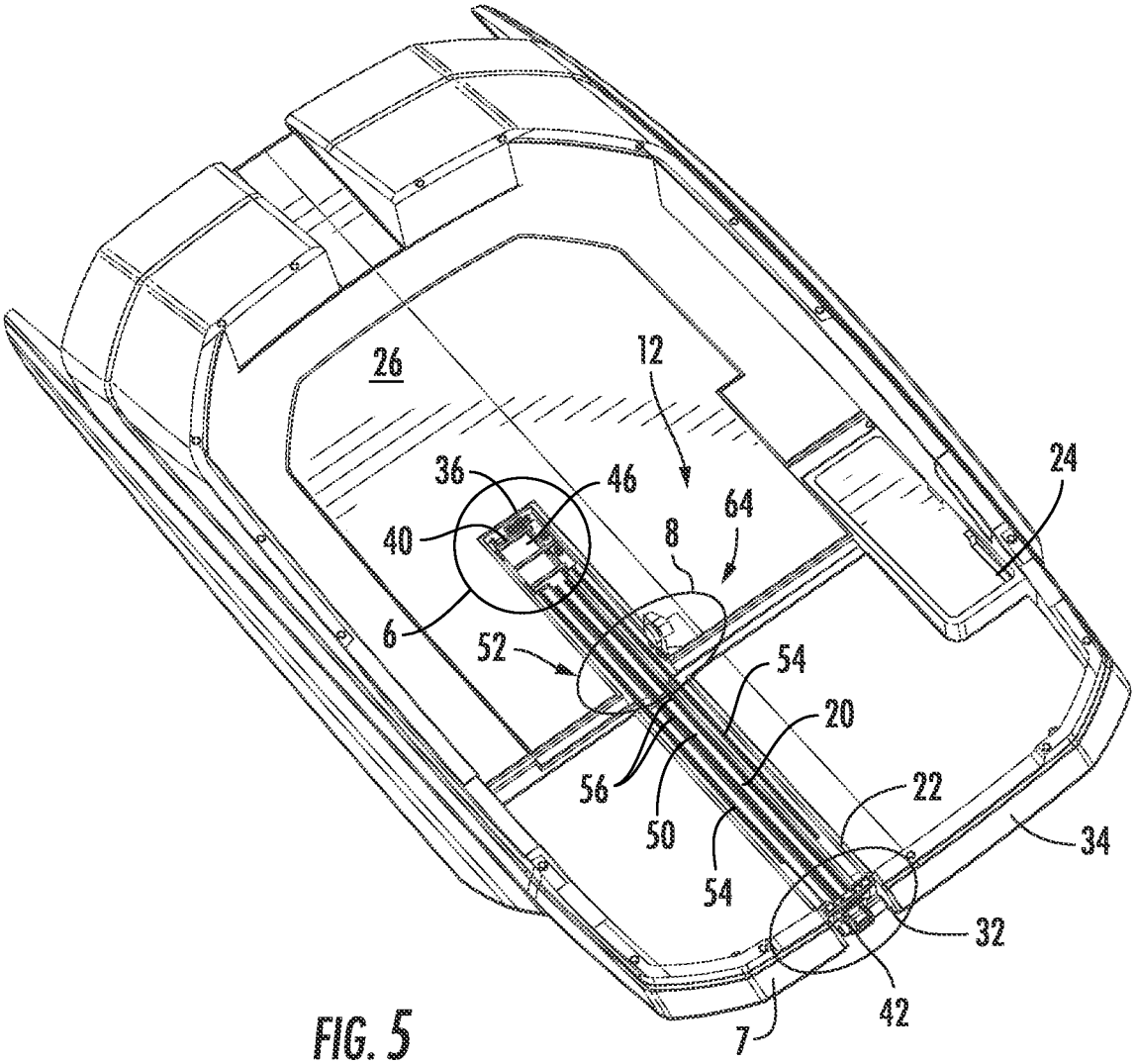
FIG. 5 is a top perspective view of a deck of the yacht FIG. 1 including the retractable davit assembly, with a cover removed from a davit arm passage to show internal details.

Referring to FIG. 5, in which a cover the davit arm passage 22 is removed to show internal details, the davit arm passage 22 extends between a terminal opening 32 at an outer edge 34 of the deck 24 and an inner end 36. It will be appreciated that a length of the davit arm passage 22 between the terminal opening 32 and the inner end 36 is many times greater than a deck internal height between the upper and lower deck surfaces 26, 30.

The davit arm 20 extends between inner and outer arm ends 40, 42. Advantageously, the outer arm end 42 includes a fairing 44 (see FIGS. 1 and 4) which matches a profile of the outer deck edge 34 surrounding the terminal opening 32. When the davit arm 20 is full retracted, the fairing 44 causes the outer arm end 42 to blend in with the outer deck edge 34, further increasing the concealment of the davit arm 20.

The davit arm 20 includes an arm support portion 46 at the inner arm end 40, which remains in the davit arm passage 22 throughout the motion of the davit arm 20, even when fully extended (as in FIG. 1). An extension portion 50 extends out through the terminal opening 32 as the davit arm 20 is extended. A width of the support portion 46 transverse the davit passage 22 is preferably greater than a width of the extension portion.

A davit bearing arrangement 52 is located in the davit arm passage 22 and carries the davit arm for movement between the fully retracted (FIGS. 3 and 4) and fully extended (FIG.

Figure 6:
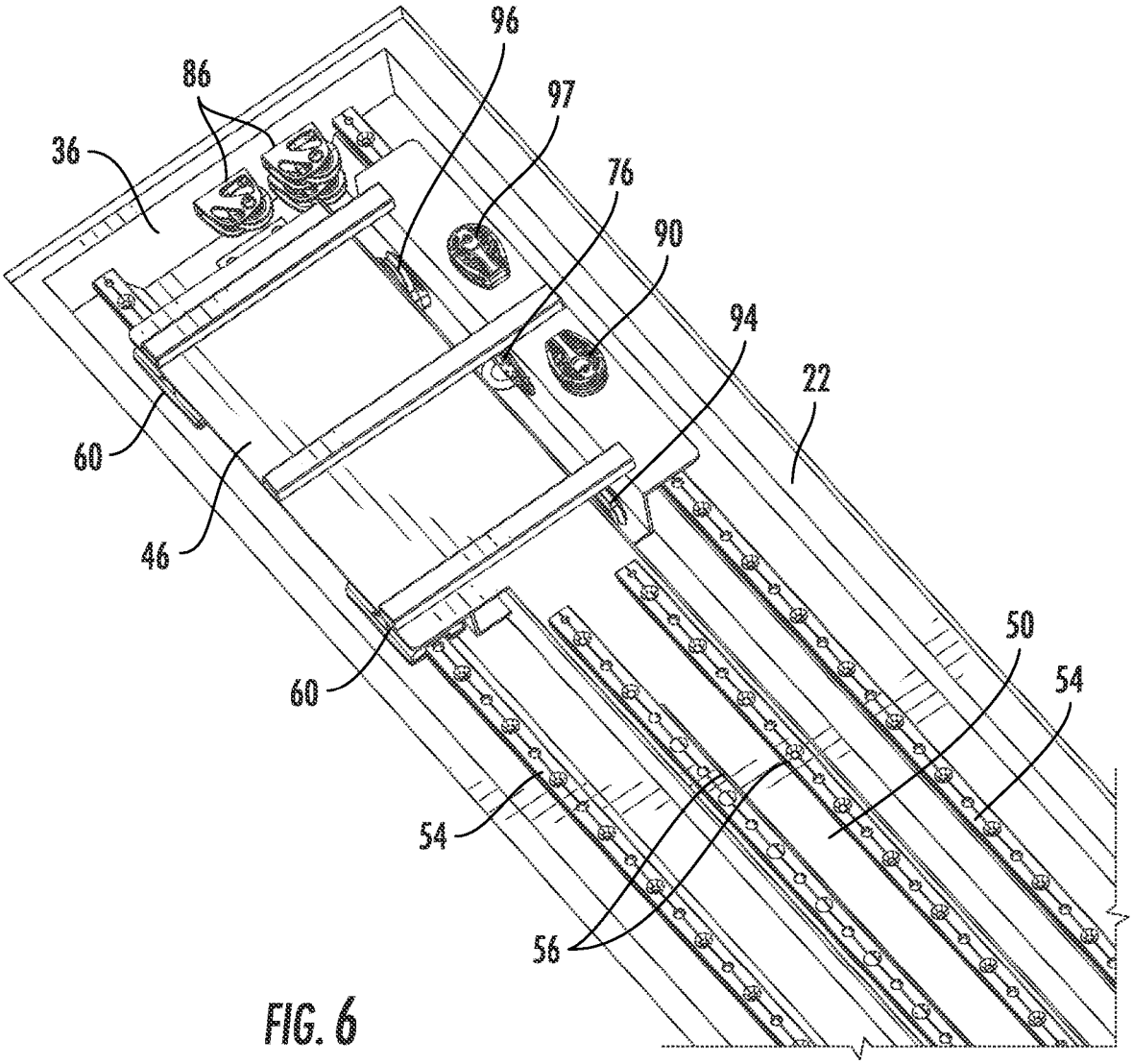
FIG. 6 is a detail view of area 6 of FIG. 5.
Figure 7:
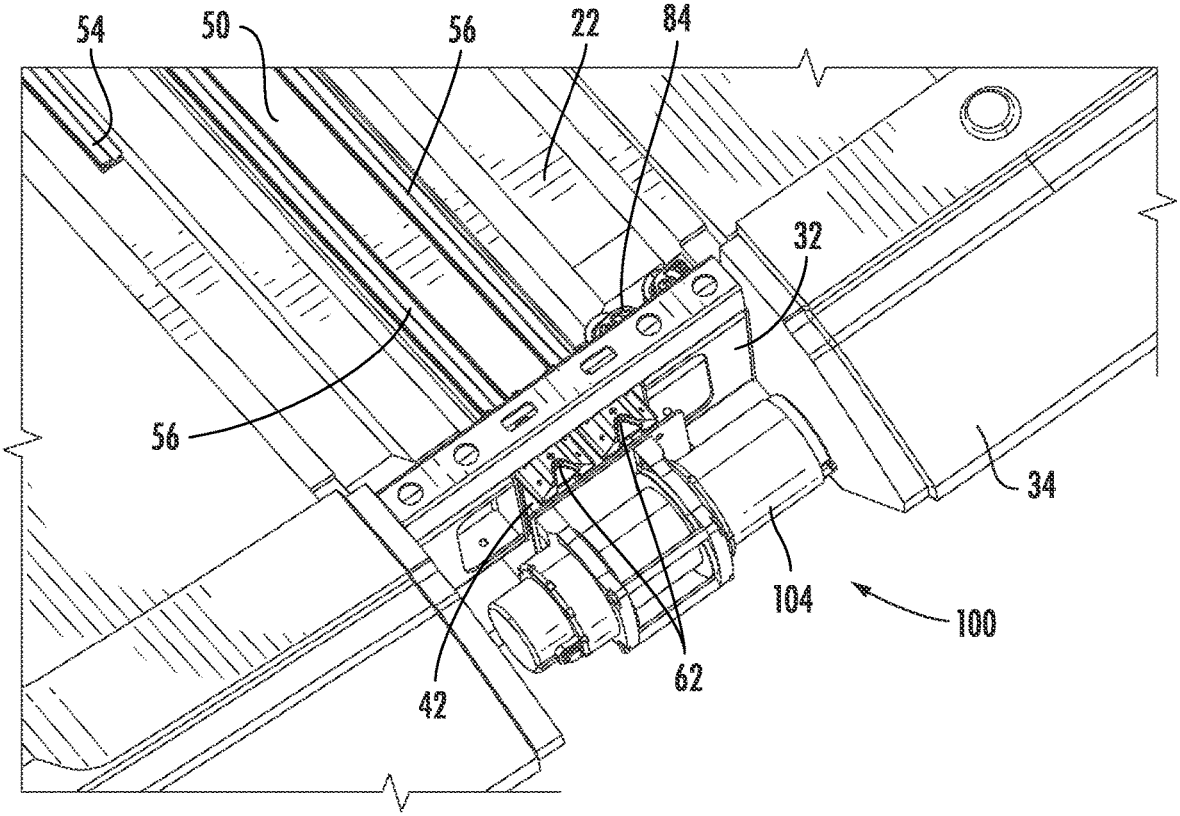
FIG. 7 is a detail view of area 7 of FIG. 5.
Figure 8:
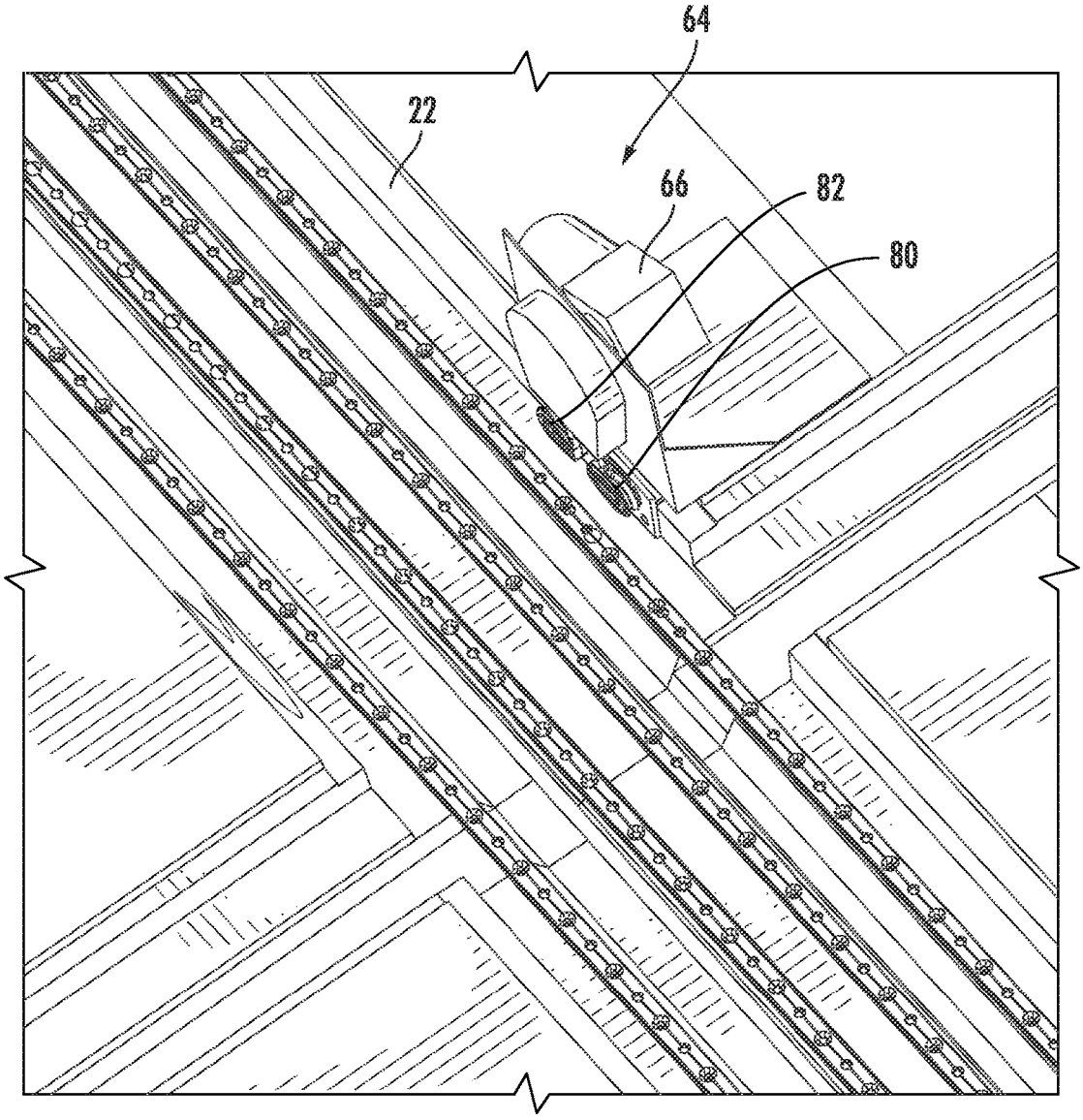
FIG. 8 is a detail view of area 8 of FIG. 5.

1) positions. Referring also to FIGS. 6 and 7, the bearing arrangement 52 preferably includes stationary slide rails 54 that are connected in the davit arm passage 22 along the length thereof and moving slide rails 56 connected along the extension portion 50 of the davit arm 20. Moving slide bearings 60 connected to the arm support portion 46 are slidably engaged with the stationary slide rails 54 while stationary slide bearings 62 are fixed in the terminal opening 32 and supporting the moving slide rails 56 for slidable movement therethrough.

While the bearing arrangement 52 represents a preferred embodiment, it will be appreciated that other bearing arrangements could be used including, but not limited to, wheels, rollers, telescoping rails, and the like.

Figure 9:
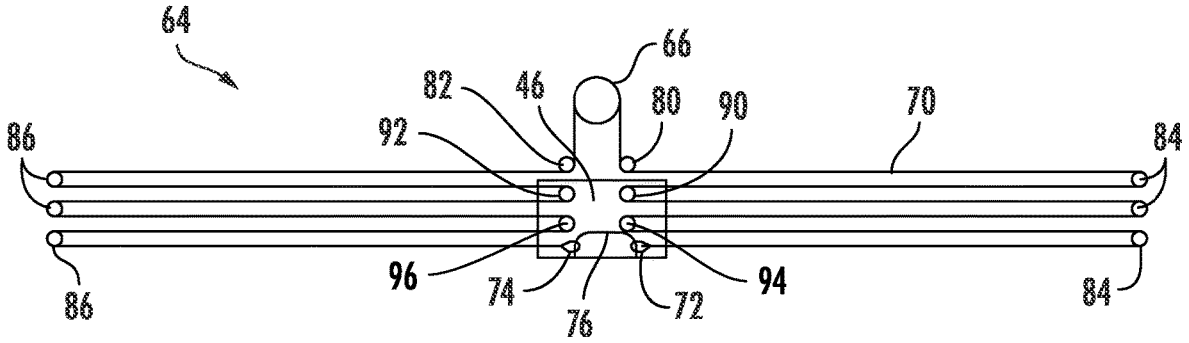
FIG. 9 is a schematic view of an arm actuation assembly of the retractable davit assembly of FIG. 1.

An arm actuation assembly 64 engages the davit arm 20 in the davit arm passage 22 and is operable to drive the davit arm 20 between the fully retracted and fully extended positions. Referring also to FIG. 9, the arm actuation assembly 64 includes an actuation winch 66 which is operable to engage a drive line 70 that connects at opposite ends 72, 74 to the arm support portion 46 of the davit arm 20.

Preferably, the drive line 70 is routed through several pulleys before the ends 72, 74 connect to a pad eye 76 on the arm support portion 46. In particular, the line 70 are routed around respective vertical pulleys 80, 82 mounted in the davit arm passage 22 at the adjacent the winch 66 so as to extend towards the terminal opening 32 and inner end 36, respectively. Respective horizontal pulleys 84, 86 receive the line 70 and route it back toward the arm support portion 46. Respective horizontal pulleys 90, 92 on the arm support portion 46 receive the line 70 and route it back towards the terminal opening 32 and inner end 36 where the line 70 is routed around another set of respective horizontal pulleys 84, 86 back to the arm support portion 46. The line 70 is then routed around respective vertical pulleys 94, 96 on the arm support portion 46 back to a final set of respective horizontal pulleys 84, 86 at the terminal opening 32 and inner end 36. The line 70 is routed around the final set of horizontal pulleys 84, 86 back to the arm support portion 46 where the ends 72, 74 connect the pad eye 76.

The above-described arm actuation assembly 64 advantageously provides excellent mechanical advantage, is contained almost entirely within the davit arm passage 22 and operable via reversing directions on the winch 66, which is a relatively simple, durable and reliable piece of marine equipment. It will be appreciated that other actuation assemblies could be used in connection with the present invention including, but not limited to, rack and pinion arrangements, drive wheels, linear actuators, hydraulic rams and the like.

A davit hoist assembly 100 includes a hoist line 102 extendable and retractable from the davit arm 20 proximate the outer arm end 42 by a hoist 104, preferably a winch. By extending and retracting the hoist line 102, the hoist assembly 100 is operable to raise and lower a dinghy 106. Various connection harnesses can be used for connecting the hoist line 102 to the dinghy 106.

In operation retrieving a dinghy 106, the davit arm 20 is fully extended using the arm actuation assembly 64, as in FIG. 1. In the depicted embodiment, the davit assembly is configured to extend the davit arm 20 out past a stern side 110 of the hull 12. It will be appreciated, however, a davit assembly according to the present invention could be configured to extend out over any other side of the hull, depending on a preferred dinghy retrieval location.

Likewise, a yacht could be equipped with more than one davit assembly extending out past the same or different sides thereof. It should also be noted that the use of a davit assembly according to the present invention is not necessarily limited to use with any particular hull form, such as the depicted catamaran. The davit assembly could be readily integrated into a superstructure carried on a monohull, trimaran or other hull form.

Once fully extended, the hoist 104 is operated to lower the hoist line 102 for attachment to the dinghy 106. Once attached to the hoist line 102, the hoist 104 is again operated to raise the dinghy 106 above the level of a dinghy storage location such a storage platform 112. The arm actuation assembly 64 is then operated to partially retract the arm to a dinghy storage position (as in FIG. 2) intermediate the fully extended and fully retracted position and the hoist 104 is operated to extend the hoist line 102 enough the lower the dinghy 106 onto the storage platform 112.

Once the dinghy 106 secured on the platform 112, the hoist line 102 is detached and fully retracted by the hoist 104. The arm actuation assembly 64 is then operated to fully retract the davit arm 20 into the davit arm passage 22, so that the fairing 44 sits flush with the outer deck edge 34 (as in FIGS. 3 and 4). It will be appreciated that the process of launching the dinghy 106 would entail substantially the reverse of the preceding steps.

The above-described embodiments are provided for illustrative purposes, the present invention is not necessarily limited thereto. Rather, those skilled in the art will appreciate that various modifications, as well as adaptations to particular circumstances, will fall within the scope of the invention herein shown and described and of the claims appended hereto.

What is claimed is:

1. A yacht comprising:

a hull having a plurality of hull sides;

a superstructure arranged on the hull and including at least one deck raised thereabove and including upper and lower deck surfaces defining an internal deck volume therebetween, a davit arm passage being formed within the internal deck volume and having a terminal opening located on an outer deck edge of the at least one deck, a length of the davit arm passage being greater than a deck internal height between the upper and lower deck surfaces;

a davit arm extending between an inner arm end and an outer arm end, the davit arm being mounted in the davit arm passage and movable between a retracted position in which the outer arm end is located at the outer deck edge and an extended position where the outer arm end is extended outwardly of the outer deck edge past one of the plurality of hull sides;

a davit bearing arrangement located in the davit arm passage and carrying the davit arm for movement between the retracted and extended positions;

an arm actuation assembly engaging the davit arm in the davit arm passage and operable to drive the davit arm between the retracted and extended positions; and a davit hoist assembly including a hoist line extendable and retractable from the davit arm proximate the outer arm end and a hoist operable to extend and retract the hoist line.

2. The yacht of claim 1, wherein the one of the plurality of hull sides past which the outer arm end is extendable is a stern side.

3. The yacht of claim 1, further comprising a dinghy storage platform located below the at least one deck, davit arm being extendable along the davit bearing arrangement by the arm actuation assembly to a dinghy storage position intermediate the retracted and extended positions in which the outer arm end is over the dinghy storage platform.

4. The yacht of claim 3, wherein the one of the plurality of hull sides past which the outer arm end is extendable is a stern side.

5. The yacht of claim 1, wherein davit arm includes a fairing at the outer arm end, the fairing matching a profile of the outer deck edge surrounding the terminal opening of the davit arm passage.

6. The yacht of claim 1, wherein the davit arm includes an arm support portion at the inner arm end that remains in the davit arm passage with the davit arm in the extended position and an extension portion extending from the arm support portion to the outer arm end, the extension portion extending out of the davit arm passage through the terminal opening with the davit arm in the extended position.

7. The yacht of claim 6, wherein an arm support portion width of the sliding arm support transverse the davit passage is greater than an extension portion width of the extension portion transverse the davit passage.

8. The yacht of claim 6, wherein the davit bearing arrangement includes a first stationary slide rail connected in the davit arm passage extending along the length thereof and a first moving slide bearing connected to the arm support portion and riding on the first stationary slide rail.

9. The yacht of claim 6, wherein the davit bearing arrangement includes a first moving slide rail connected along the extension portion and a first stationary slide bearing fixed in the terminal opening and slidably supporting the first moving slide rail.

10. The yacht of claim 9, wherein the davit bearing arrangement further includes a first stationary slide rail connected in the davit arm passage extending along the length thereof and a first moving slide bearing connected to the arm support portion and riding on the first stationary slide rail.

11. The yacht of claim 6, wherein the arm actuation assembly includes an actuation winch operable to engage a drive line connected at opposite ends to the arm support portion of the davit arm.

12. The yacht of claim 11, wherein the drive loop is routed around at least a first pulley adjacent to the terminal opening and at least a second pulley adjacent an inner end of the davit arm passage.

13. The yacht of claim 1, wherein the davit hoist assembly includes a hoist winch carried by the outer arm end.

14. The yacht of claim 13, wherein the davit arm includes a fairing at the outer arm end, the fairing matching a profile of the outer deck edge surrounding the terminal opening of the davit arm passage, and the hoist winch is located inside the fairing.

15. A yacht comprising:

a hull having a plurality of hull sides;

a superstructure arranged on the hull and including at least one deck raised thereabove and including upper and lower deck surfaces defining an internal deck volume therebetween, a davit arm passage being formed within the internal deck volume and having a terminal opening located on an outer deck edge of the at least one deck, a length of the davit arm passage being greater than a deck internal height between the upper and lower deck surfaces;

a davit arm extending between an inner arm end and an outer arm end, the davit arm being mounted in the davit arm passage and movable between a retracted position in which the outer arm end is located at the outer deck edge and an extended position where the outer arm end is extended outwardly of the outer deck edge past one of the plurality of hull sides, the davit arm including a fairing at the outer arm end, the fairing matching a profile of the outer deck edge surrounding the terminal opening of the davit arm passage;

a davit bearing arrangement located in the davit arm passage and carrying the davit arm for movement between the retracted and extended positions;

an arm actuation assembly engaging the davit arm in the davit arm passage and operable to drive the davit arm between the retracted and extended positions; and a davit hoist assembly including a hoist line extendable and retractable from the davit arm proximate the outer arm end and a hoist operable to extend and retract the hoist line.

16. The yacht of claim 15, wherein the davit hoist assembly includes a hoist winch carried by the outer arm end, the hoist winch being located inside the fairing.

17. A yacht comprising:

a hull having a plurality of hull sides;

a superstructure arranged on the hull and including at least one deck raised thereabove and including upper and lower deck surfaces defining an internal deck volume therebetween, a davit arm passage being formed within the internal deck volume and having a terminal opening located on an outer deck edge of the at least one deck, a length of the davit arm passage being greater than a deck internal height between the upper and lower deck surfaces;

a davit arm extending between an inner arm end and an outer arm end, the davit arm being mounted in the davit arm passage and movable between a retracted position in which the outer arm end is located at the outer deck edge and an extended position where the outer arm end is extended outwardly of the outer deck edge past one of the plurality of hull sides, the davit arm including an arm support portion at the inner arm end that remains in the davit arm passage with the davit arm in the extended position and an extension portion extending from the arm support portion to the outer arm end, the extension portion extending out of the davit arm passage through the terminal opening with the davit arm in the extended position;

a davit bearing arrangement located in the davit arm passage and carrying the davit arm for movement between the retracted and extended positions, the davit bearing arrangement including a first stationary slide rail connected in the davit arm passage extending along the length thereof, a first moving slide bearing connected to the arm support portion and riding on the first stationary slide rail, a first moving slide rail extending along the extension portion, and a first stationary slide bearing fixed in the terminal opening and slidably supporting the first moving slide rail;

an arm actuation assembly engaging the davit arm in the davit arm passage and operable to drive the davit arm between the retracted and extended positions; and a davit hoist assembly including a hoist line extendable and retractable from the davit arm proximate the outer arm end and a hoist operable to extend and retract the hoist line.

18. The yacht of claim 17, wherein an arm support portion width of the sliding arm support transverse the davit passage is greater than an extension portion width of the extension portion transverse the davit passage.

19. The yacht of claim 18, wherein the davit bearing arrangement further includes a second stationary slide rail connected in the davit arm passage extending along the length thereof in parallel with the first stationary slide rail, a second moving slide bearing connected to the arm support portion and riding on the second stationary slide rail, a second moving slide rail extending along the extension portion in parallel with the first moving slide rail, and a second stationary slide bearing fixed in the terminal opening and slidably supporting the second moving slide rail.

20. The yacht of claim 19, wherein, transverse the davit arm passage, the first and second stationary slide rails are located outwardly, and on opposite sides, of the first and second moving slide rails.

* * * * *